US008308116B2

(12) United States Patent
Daniels

(10) Patent No.: US 8,308,116 B2
(45) Date of Patent: Nov. 13, 2012

(54) HANGER ASSEMBLY

(75) Inventor: James Daniels, Stokesdale, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 0 days.

(21) Appl. No.: 12/838,043

(22) Filed: Jul. 16, 2010

(65) Prior Publication Data

US 2012/0012726 A1 Jan. 19, 2012

(51) Int. Cl.
*A47F 5/08* (2006.01)

(52) U.S. Cl. .... 248/215; 248/304; 248/340; 211/106.01

(58) Field of Classification Search ..... 248/339, 248/340, 341, 304, 214, 215; 211/106.01, 211/87.01
See application file for complete search history.

(56) References Cited

U.S. PATENT DOCUMENTS

| | | | | |
|---|---|---|---|---|
| 309,621 | A | 12/1884 | Herrick et al. | |
| 327,939 | A | 10/1885 | Garrison | |
| 423,730 | A | 3/1890 | Charlton | |
| 478,025 | A | 6/1892 | Schraudner | |
| 683,248 | A | 9/1901 | Chase | |
| 988,743 | A | 4/1911 | Stillwaggon | |
| D43,289 | S | 11/1912 | Sternau | |
| 1,848,937 | A * | 3/1932 | Coventry | 248/223.41 |
| 1,930,656 | A | 10/1933 | Nave | |
| 1,958,497 | A | 5/1934 | Rivers | |
| 2,312,985 | A | 11/1940 | Bales | |
| 2,988,315 | A | 6/1961 | Saxe | |
| 3,443,783 | A | 5/1969 | Fisher | |
| 3,625,464 | A | 12/1971 | Conran | |
| 3,826,458 | A | 7/1974 | Fisher | |
| 3,891,172 | A | 6/1975 | Einhorn | |
| 4,069,920 | A | 1/1978 | Ross | |
| 4,082,243 | A | 4/1978 | Watt, Jr. et al. | |
| 4,240,129 | A | 12/1980 | Kawazoe | |
| 4,264,013 | A | 4/1981 | Vollmer | |
| 4,372,450 | A | 2/1983 | Licari et al. | |
| 4,658,967 | A * | 4/1987 | Wang | 211/94.01 |
| 5,154,304 | A | 10/1992 | McAuley | |
| 5,372,346 | A | 12/1994 | Upchurch et al. | |
| 5,507,545 | A | 4/1996 | Krysiak | |
| 5,727,698 | A * | 3/1998 | Lai | 211/87.01 |
| D472,134 | S * | 3/2003 | Goodman et al. | D8/372 |
| D473,455 | S * | 4/2003 | Goodman et al. | D8/372 |
| 6,769,656 | B1 * | 8/2004 | Botkin et al. | 248/220.31 |
| 7,017,877 | B2 | 3/2006 | Melton et al. | |
| 7,967,268 | B2 * | 6/2011 | Herron et al. | 248/243 |
| 2007/0063119 | A1 | 3/2007 | Huang | |
| 2010/0084530 | A1 | 4/2010 | Lai | |

* cited by examiner

*Primary Examiner* — Terrell McKinnon
*Assistant Examiner* — Steven Marsh
(74) *Attorney, Agent, or Firm* — Carlson, Gaskey & Olds, P.C.

(57) ABSTRACT

A hanger assembly has a rail having a front portion, a back portion, and a rail opening therethrough. The rail opening has a shape having a larger diameter at the back portion and a smaller diameter at the front portion. A plug conforms to the shape of the opening, has a plug opening therein and a lip disposed upon an internal surface thereof. The lip engages a hook having an extension for insertion into the plug opening and engaging the lip within the plug.

10 Claims, 3 Drawing Sheets

HANGER ASSEMBLY

BACKGROUND OF THE INVENTION

Decorative hooks are placed on site by users in hook rails both for ease of shipping and to allow the look or shape of the decorative hooks to be changed for aesthetic reasons.

SUMMARY OF THE INVENTION

According to an exemplar of the hanger assembly shown herein, the hanger assembly has a rail having a front portion, a back portion, and a rail opening therethrough. The rail opening has a shape having a larger diameter at the back portion and a smaller diameter at the front portion. A plug conforms to the shape of the opening, has a plug opening therein and a lip disposed upon an internal surface thereof. The lip engages a hook having an extension for insertion into the plug opening and engaging the lip within the plug.

According to a further exemplar of the hanger assembly shown herein, the hanger assembly has a hook rail having a front portion, a back portion, and a hook rail opening therethrough. The hook rail opening has a shape having a larger diameter at the back portion and a smaller diameter at the front portion. A plug conforms to the shape of the opening, has a plug opening therein and a lip disposed upon an internal surface thereof. The plug is compressed in the opening. A hook has an extension for insertion into the plug opening and engages the lip within the plug.

According to a still further exemplar of the hanger assembly shown herein, a method of installing a hook in a rail includes providing a rail having a front portion, a back portion, and a rail opening therethrough wherein the hook rail opening has a shape having a larger diameter at the back portion and a smaller diameter at the front portion. The method further includes compressing a plug within a counter sunk opening such that the plug conforms to the shape and inserting a shank of a decorative hook through an opening in the plug and securing the shank to the plug.

These and other features of the present invention can be best understood from the following specification and drawings, the following of which is a brief description.

DETAILED DESCRIPTION OF THE PREFERRED EMBODIMENT

Figure 1:
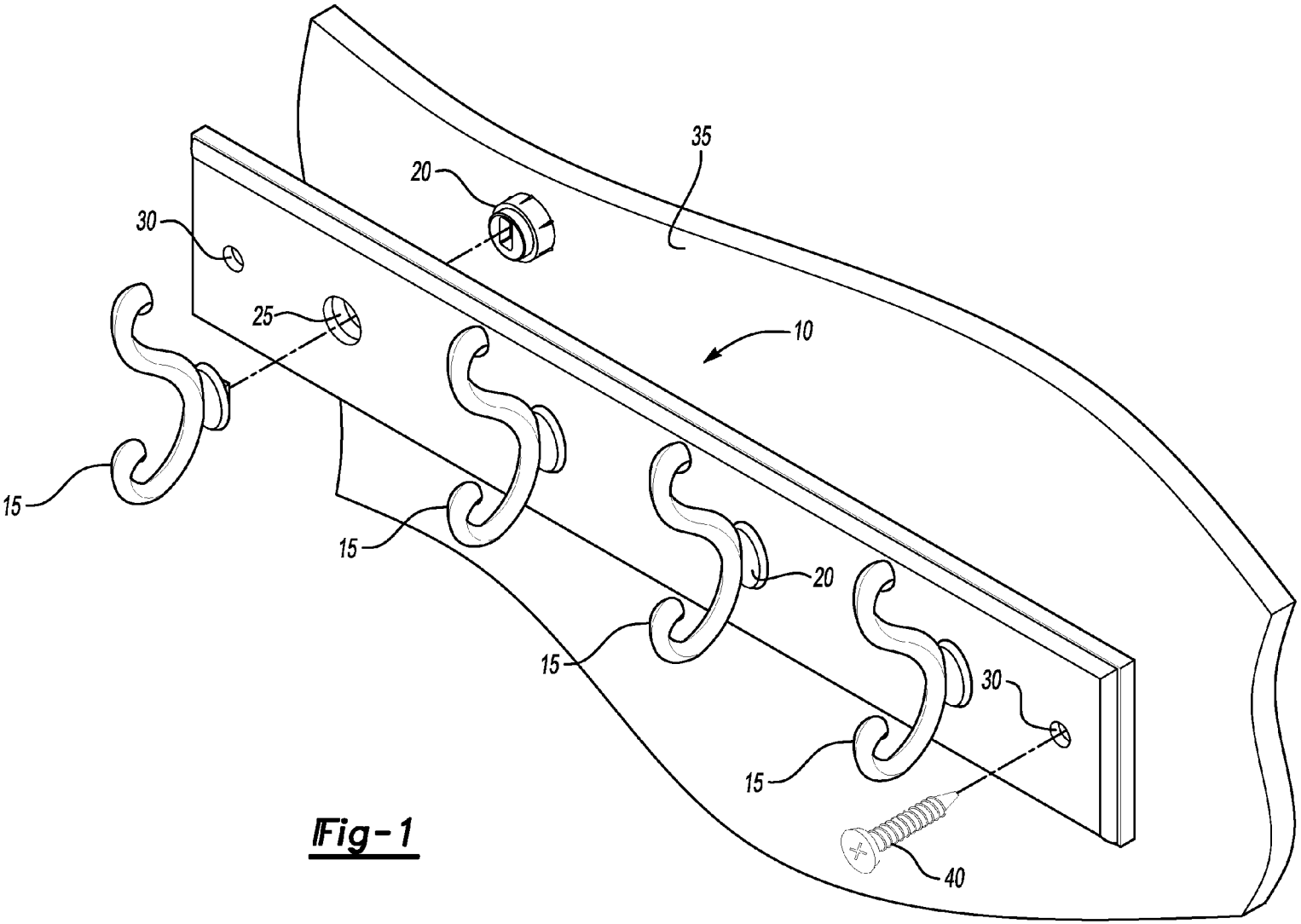
FIG. 1 is a perspective view of a hook rail.

Referring now to FIG. 1 a hook rail 10 that incorporates decorative hook 15 in cooperation with a plug 20 is shown. The hook rail has a plurality of counter sunk holes 25 as will be discussed herein. A plug 20, which may be constructed of a plastic, wood or the like, is disposed in each one of the counter sunk holes 25 as will be discussed herein and attaches to a decorative hook 15. Each hook rail 10 has a pair of openings 30 for anchoring the hook rail 10 to a wall 35 or the like by screws 40 or the like.

Figure 2:
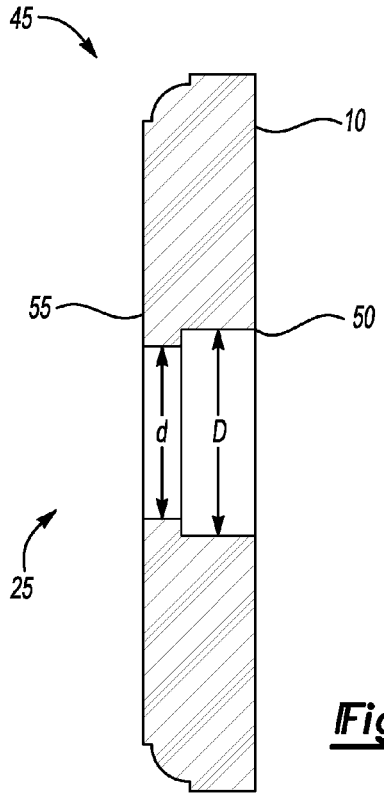
FIG. 2 is a side view of the hook rail of FIG. 1.

Referring now to FIG. 2, a cross sectional view of the hook rail 10 of FIG. 1 is shown. The hook rail 10, which is commonly constructed of wood, has a decorative cross section 45 with the counter sunk hole 25. The countersunk hole has a large diameter D at the back 50 of the hook rail and a smaller diameter d, coaxial with the diameter D extending through the front 55 of the hook rail 10. The counter sunk hole 25 receives the plug 20 as will be shown herein.

Figure 3:
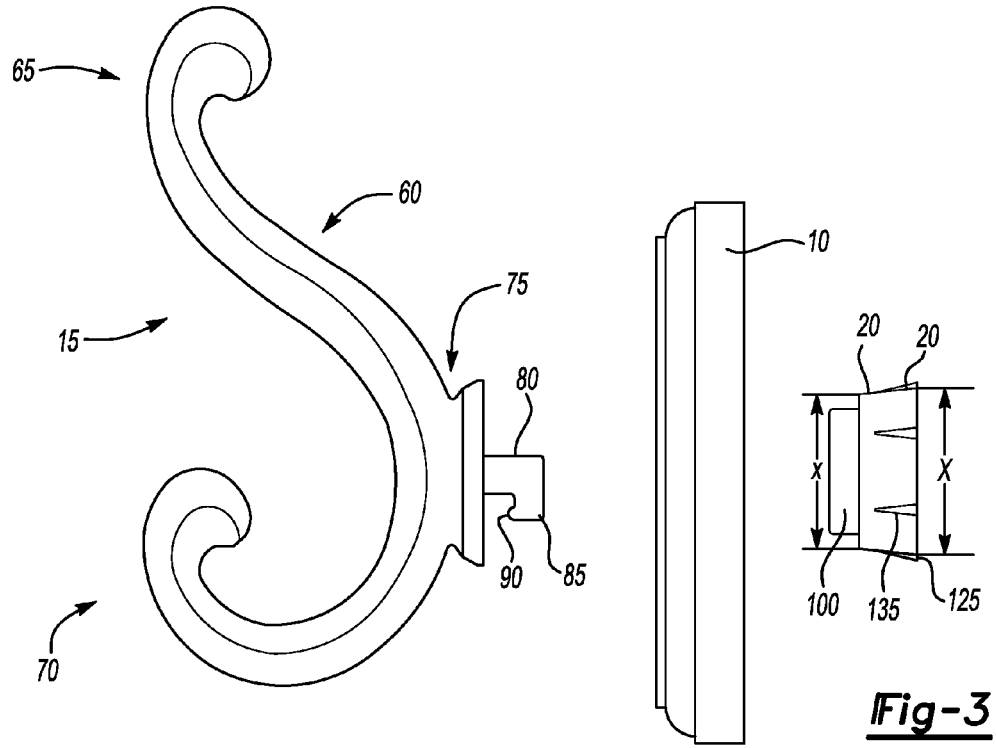
FIG. 3 is a side view of a decorative hook of a hook rail and a plug of FIG. 1.

Referring now to FIG. 3, the decorative hook 15 is shown. The decorative hook 15 has a standard clef-like hook 60 having a top area 65 and a bottom area 70 for holding material like clothing or the like, both the top hook and bottom hook attaching to a corbel 75. The corbel 75 in turn attaches to a shank 80 extending towards the hook rail 10 for passing into the plug 20 disposed in the hook rail. The shank 80, which has a rectangular cross-sectional shape, has a tab 85 portion extending downwardly therefrom. The tab 85 has a lip 90 extending towards the corbel 75. The decorative hook may assume many different shapes and such shapes are contemplated herein. The decorative hook may be made of one piece of a plastic material or the like.

Figure 4:
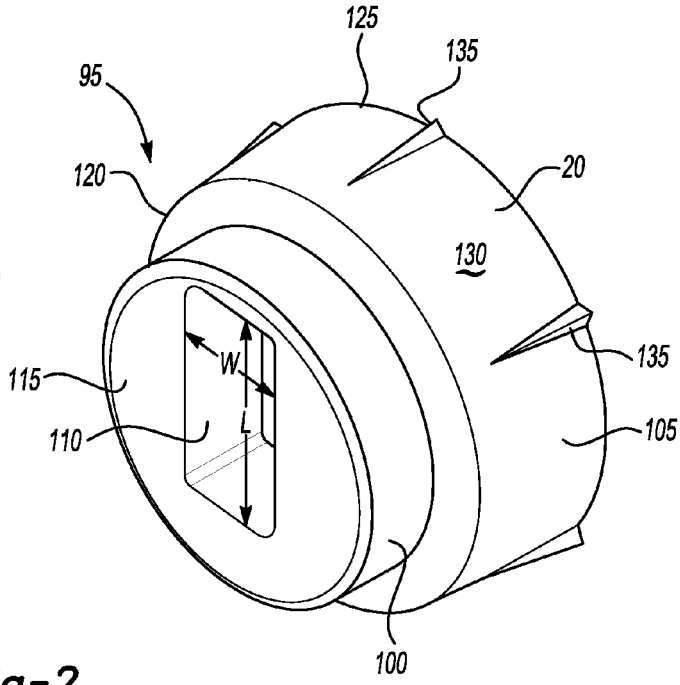
FIG. 4 is a perspective view of a plug of FIG. 1.
Figure 5:
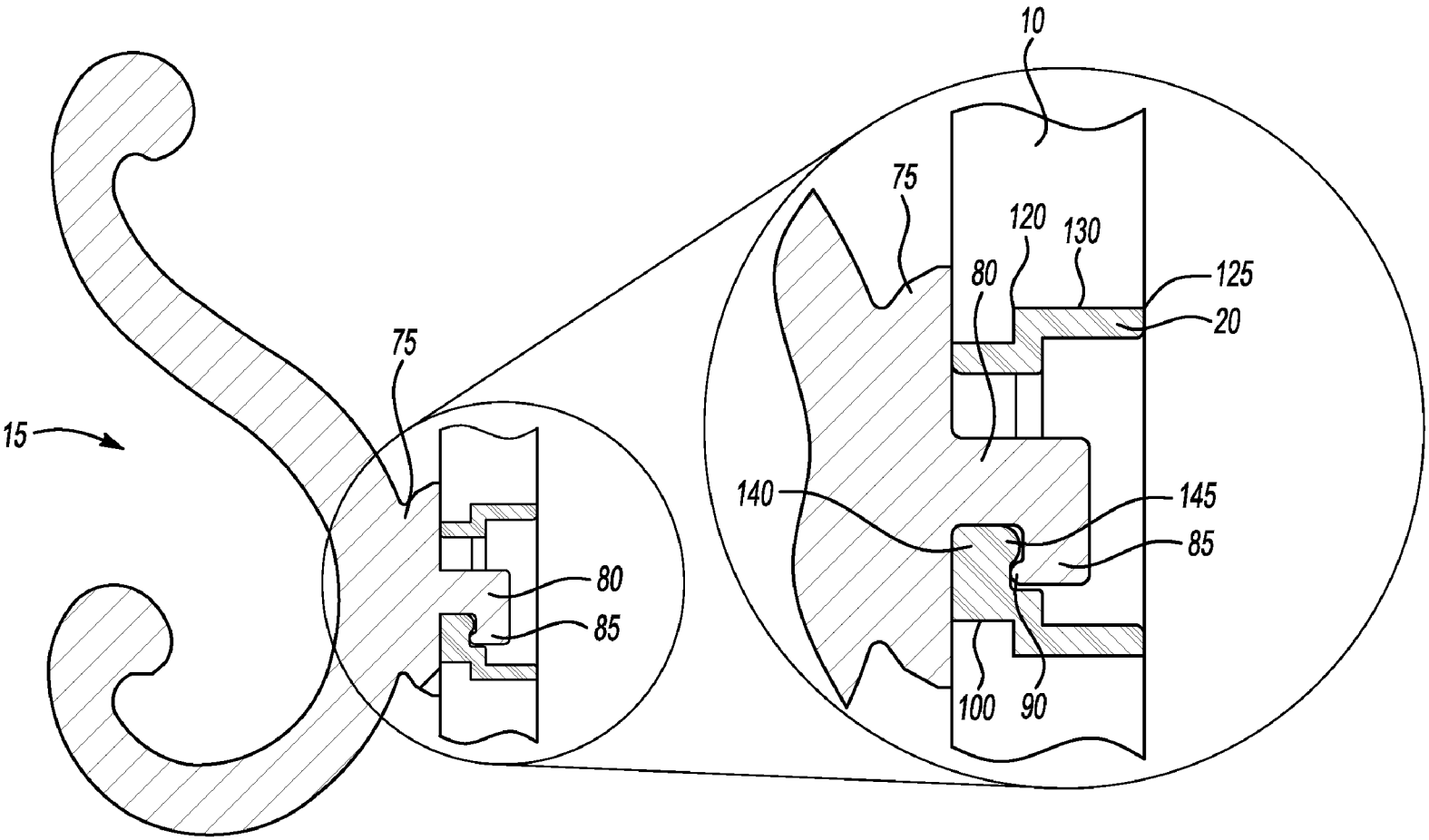
FIG. 5 is a sectional view cutaway and partially expanded of a decorative hook and a plug.

Referring now to FIGS. 3, 4 and 5, the plug 20 is shown. The plug 20 has a hollow body 95 having a conical portion 100 and a frustoconical portion 105 that are coaxial with each other to fit in the countersunk hole 25. A rectangular opening 110 that conforms to a width W of the shank 80 and a length L that conforms to the length of the shank with the tab 85 disposed within the face 115 of the conical portion 100. The frustoconical portion 105 has a first area 120 having a diameter x that abuts the conical portion 100 and a second area 125 having a diameter X axially displaced from the first diameter x so that the side 130 tapers outwardly from the first diameter x. The frustoconical portion 105 has a plurality of tapered ribs 135 that engage the diameter D of the counter sunk holes 25 so that the plug 20 does not rotate if inserted therein. If inserted in a counter sunk hole 25, the frustoconical portion 105 compresses as insertion into the counter sunk hole 25 causes the diameter X of the plug to compress and be held tightly in the counter sunk hole 25. Though a conical shape and a frustoconical shape are contemplated herein, other shapes that may compress like a frusto-pyramidal shape are contemplated herein. While the ribs 135 act as anti-rotation devices, other shapes are contemplated herein.

As can be seen in FIG. 5, the conical portion 100 has an abutment 140 that carries an axially inwardly extending bead 145 within the hollow body 95 plug for engaging the lip 90 of the tab 85. This lip 60 and the bead 145 cooperate such that once inserted the shank 80 is not readily removed from the plug 20 without applying an upward force against the corbel 75 that attaches to the shank 80 that attaches to the tab 85.

To mount a hook 15 to the hook rail 10, a plug 20 is inserted into the counter sunk hole 25 so that the rectangular opening 110 is vertically oriented. The rectangular shank 80 is inserted into the rectangular opening 110 and the corbel 75 is pushed downwardly until the lip 90 clicks and is secured over the bead 145. If a different decorative hook is required due to breakage or aesthetic reasons, the process is reversed, e.g., the decorative hook is pushed upwardly until the lip 90 disengages the bead 145. Because the counter sunk hole 25 has its larger diameter X at the back of the hook rail 10, the plug may not be pulled from the hook rail 10. Also because upward force is required to remove the decorative hook 15, the hook is relatively secure for downwardly depending weight of articles hanging therefrom.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A hanger assembly comprising a rail having a front portion, a back portion, and a rail opening therethrough said rail opening having a shape having a larger diameter at said back portion and a smaller diameter at said front portion;

a plug conforming to said shape of said opening and having a plug opening therein said plug having a lip disposed upon an internal surface thereof, said plug comprising a first portion having a first diameter for insertion into said smaller diameter and a second portion having a second diameter for insertion into said larger diameter, wherein said second portion has a larger dimension than if not inserted into said larger diameter and a smaller dimension if inserted into said larger diameter; and a hook having an extension for insertion into said plug opening and engaging said lip within said plug.

2. The hanger assembly of claim 1 wherein said second portion has a frustoconical shape.

3. A hanger assembly comprising;

a hook rail having a front portion, a back portion, and a hook rail opening therethrough said hook rail opening having a shape having a larger diameter at said back portion and a smaller diameter at said front portion, a plug conforming to said shape of said opening and having a plug opening therein said plug having a lip disposed upon an internal surface thereof, wherein said plug is compressed in said opening, and a hook having an extension for insertion into said plug opening and engaging said lip within said plug.

4. The hanger assembly of claim 3 wherein said plug further comprises:

a first portion having a first diameter for insertion into said smaller diameter a second portion having a second diameter for insertion into said larger diameter.

5. The hanger assembly of claim 4 wherein said second portion has a larger dimension than if not inserted into said larger diameter and a smaller dimension if inserted into said larger diameter.

6. The hanger assembly of claim 5 wherein said second portion has a frustoconical shape.

7. The hanger assembly of claim 3 wherein said plug has an anti-rotation rib disposed thereon.

8. The hanger assembly of claim 7 wherein said plug further comprise a first portion having a first diameter for insertion into said smaller diameter; a second portion having a second diameter for insertion into said larger diameter and wherein said rib is disposed on said second portion and wherein said rib is disposed on said second portion.

9. A method of installing a hanger in a rail comprising;

providing a rail having a a front portion, a back portion, and a rail opening therethrough said rail opening having a shape having a larger diameter at said back portion and a smaller diameter at said front portion, compressing a plug within a counter sunk opening such that said plug conforms to said shape and inserting a shank of a decorative hook through an opening in said plug and securing said shank to said plug.

10. The method of claim 9 wherein said plug is compressed in said larger diameter of said shape.

* * * * *